US005309946A

United States Patent [19]

Ligneul

[11] Patent Number: 5,309,946

[45] Date of Patent: May 10, 1994

[54] FLOW RECTIFIER

[75] Inventor: Patrice Ligneul, Chaville, France

[73] Assignee: Schlumberger Industries, S.A., Montrouge, France

[21] Appl. No.: 961,607

[22] Filed: Oct. 15, 1992

[30] Foreign Application Priority Data

Oct. 25, 1991 [FR] France ..... 91 13298

[51] Int. Cl.[5] ..... F15D 1/04

[52] U.S. Cl. ..... 138/39; 138/42; 138/44; 366/337

[58] Field of Search ..... 138/37, 39, 42, 44, 138/112; 366/337, 340; 137/8; 239/590

[56] References Cited

U.S. PATENT DOCUMENTS

| | | | |
|---|---|---|---|
| 813,918 | 2/1906 | Schmitz | 138/38 |
| 814,694 | 3/1906 | Henderson | 138/37 |
| 1,648,708 | 11/1927 | Wilkinson | 138/44 |
| 1,940,790 | 12/1933 | Diehl | 138/44 |
| 3,043,141 | 7/1962 | Waugh et al. | 138/37 |
| 3,051,452 | 8/1962 | Nobel | 366/337 |
| 3,363,843 | 1/1968 | Ballard et al. | 239/590 |
| 3,841,568 | 10/1974 | Broad | 138/39 |
| 4,352,378 | 10/1982 | Bergmann et al. | 366/337 |
| 4,533,083 | 8/1985 | Tucker | 138/42 |
| 4,660,587 | 4/1987 | Rizzie | 138/37 |
| 4,929,088 | 5/1990 | Smith | 366/337 |
| 4,981,368 | 1/1991 | Smith | 366/337 |
| 5,092,366 | 3/1992 | Sakamoto | 138/39 |

FOREIGN PATENT DOCUMENTS

| | | | |
|---|---|---|---|
| 0520074 | 12/1955 | Canada | 138/39 |
| 0203293 | 10/1908 | Fed. Rep. of Germany | 138/38 |
| 0362995 | 4/1906 | France | 138/38 |
| 2213429 | 8/1974 | France . | |
| 2306356 | 10/1976 | France . | |
| 0196414 | 10/1985 | Japan | 138/37 |
| 0020606 | 12/1899 | Switzerland | 138/38 |

*Primary Examiner*—Harvey C. Hornsby
*Assistant Examiner*—James F. Hook
*Attorney, Agent, or Firm*—Sanford J. Asman

[57] ABSTRACT

A flow rectifier for mounting in a circular section duct conveying a fluid flow, the rectifier establishing two series of oppositely-rotating vortices in a ring, which vortices cancel one another, and are created by two series of angularly offset fins. The first series of fins is disposed uniformly around the inside surface of the ring while the second series of fins is disposed uniformly around a circumference centered on the center of the ring.

8 Claims, 1 Drawing Sheet

FLOW RECTIFIER

The present invention relates to a device known as a "flow rectifier" intended to be mounted in a duct along which a fluid is flowing for the purpose of obtaining a flow that is free from vortices that could disturb possible flow rate or other measurements.

BACKGROUND OF THE INVENTION

There are two types of defect that a flow may present which disturb the taking of measurements, and in particular measuring flow rate.

A first defect comes from asymmetry in the velocity distribution of the fluid in a plane perpendicular to the flow direction. Such asymmetry may be caused, for example, by a bend in the duct or by the shutter of a valve that is half-closed, e.g. a wedge valve.

Another defect consists in the presence of vortices that are coaxial with the duct and that may be generated spontaneously during the flow of the fluid or that may be the result of passing through a half-closed valve, as above.

In fact, neither type of defect ever exists in isolation, such that both defects are always present simultaneously in the turbulence that occurs in the fluid.

Several different devices are known that are suitable for making the velocity profile of a flow of fluid along a duct more uniform.

For example, proposals have been made to place a cylindrical chamber in the duct, the chamber including longitudinally extending ribs regularly disposed around the inside surface of the chamber. These ribs have increasing radial extent in the flow direction. Apparatuses of that type suffer from the major drawback of extending over a considerable longitudinal distance, of the order of 4 to 5 times the diameter of the inlet duct. Such a longitudinal extent is necessary to obtain a flow that has been made properly uniform. It will be understood that it increases the space required for a measurement assembly in a manner that is unfavorable.

Another device, known as a "honeycomb" comprises a large number of tubes disposed longitudinally in a cylindrical chamber installed in the duct.

In addition to the fact that such a structure is expensive both to manufacture and to install, a honeycomb apparatus requires considerable longitudinal extent, as in the preceding case.

A "star rectifier" apparatus is also known which comprises a cylindrical chamber mounted in the duct and in which walls are regularly disposed so as to constitute, in section, four or more diameters. That apparatus operates in a manner substantially similar to the honeycomb apparatus and suffers from the same drawbacks.

Those various apparatuses are discussed in the work by R. W. Miller entitled "Flow measurement engineering handbook", published by McGraw Hill, New York, 1989.

An article by K. Akaski et al., entitled "Development of a new flow rectifier for shortening upstream straight pipe length of flowmeters" published in IMEKO Tokyo, SIC, 12b-5, pp. 279–284 (1979), describes apparatus occupying much less space. The apparatus comprises a single plate pierced by constant diameter holes in a given two-dimensional distribution. Although that apparatus is compact, it nevertheless suffers from the drawback of suffering from a high headloss coefficient, of the order of two. The inevitable drop in pressure in the flow on passing through the plate gives rise to a major loss of energy.

An article by C. R. Smith et al., entitled "Using passive vortex generation devices", 5th International IMEKO Conference on Flow Measurement, Dusseldorf 1989, describes apparatus comprising two series of fins for making a flow more uniform.

Four fins are mounted on the inside face of the duct and extend parallel to its axis. They serve to transform overall rotation into four marginal vortices. No fin apparatus is envisaged for establishing vortices that are counter-rotating relative to the above vortices (thus leaving it open to the secondary marginal vortices to recombine, thereby establishing a flow that rotates in the opposite direction). The longitudinal extent of such fins is believed to be two duct diameters.

Four fins are mounted on the inside face of the duct downstream from said first series of fins, the four fins extending perpendicularly to the axis of the duct and making an angle of 30° with a meridian of the duct. Each fin occupies a fraction comprising about ⅛th of the circumference of the duct and the radial extent of its projection on the axis of the duct is about 1/6th of the diameter.

A "hairpin" vortex having a longitudinal axis is established at the base of each of the fins, regardless of the overall rotation of the flow, thereby giving rise to intense turbulent mixing for the purpose of making the axial velocity distribution more uniform.

To rectify the flow, that apparatus creates a turbulent mixture that dissipates energy taken from the axial component of the velocity of the fluid, thereby giving rise to a non-negligible drop in dynamic pressure.

That device extends longitudinally over about four times the diameter of the duct, i.e. its longitudinal extent is large.

An object of the invention is therefore to rectify a flow for the purpose of making the velocity profile of a fluid flow in a duct more uniform, while occupying a distance that is very short in comparison to the diameter of said duct, thereby making it possible to reduce the bulk of a measurement assembly.

The invention also enables the velocity profile to be made more uniform without giving rise to a large headloss coefficient.

SUMMARY OF THE INVENTION

More precisely, the present invention provides a flow rectifier for mounting in a circular section duct conveying a fluid, the rectifier and comprising in a ring:

first means for creating a first series of transverse vortices all having a first direction of rotation; and second means for creating a second series of transverse vortices all having a direction of rotation opposite to the first direction of rotation and paired with the vortices created by the first means.

The apparatus of the invention thus makes it possible to transform a main vortex present in the flow into a multitude of vortices of small size.

Since adjacent vortices rotate in opposite directions from each other they tend to cancel, thereby increasing effectiveness and reducing the distance beyond which the flow becomes more uniform.

According to the invention, the vortices of the first and second series are distributed substantially in a peripheral region of the ring.

The rotary velocity of the rotating fluid increases from the center towards the inside edge of the duct. By creating secondary vortices in the peripheral ring, maximum efficiency is obtained.

In an advantageous embodiment, the first means for creating the first series of vortices comprise a first series of fins extending radially, and regularly distributed around the inside surface of the ring.

Advantageously, the second means for creating the second series of vortices comprise a second series of radially-extending fins disposed around a circumference centered on the center of the ring.

Advantageously, the second series of fins leaves free an axial circular passage.

In a preferred embodiment, the first means for creating a first series of vortices comprise a first series of fins extending radially and uniformly distributed around the inside surface of the ring; and the second means for creating a second series of vortices comprise: a circular support centered on the center of the ring, the circular support delimiting an axial passage; and a second series of fins extending radially, uniformly distributed around the circular support and pointing towards the inside surface of the ring, the fins of the second series being angularly offset relative to the fins of the first series.

Advantageously, in this embodiment, the first series of fins is contained in a peripheral region, and the ends of the fins of the second series penetrate into said peripheral region.

In a variant embodiment, the rectifier includes internal fins fixed on the circular support and extending into the axial passage.

Preferably, the internal fins are extensions of the fins of the second series.

BRIEF DESCRIPTION OF THE DRAWING

An embodiment of the invention is described by way of example with reference to the accompanying drawing, in which.

DETAILED DESCRIPTION

Figure 2:
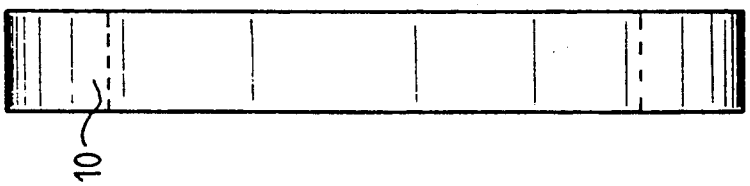
FIG. 2 is a diagrammatic side view of said embodiment.

An embodiment of the invention is described below with reference to FIGS. 1 and 2. The rectifier 1 comprises a ring 10 suitable for mounting in a duct that conveys the flow to be rectified.

A first series of fins 12 is regularly distributed radially on the inside of the ring 10. Where D represents the diameter of the duct (not shown), and in this embodiment the inside diameter of the ring 10, the fins have a length of 0.15 D and a longitudinal extent of 0.2 D, for example.

A second series of fins 14*a* is regularly distributed radially on a circular support 16 centered on the center of the ring 10.

The fins 14*a* point towards the inside surface of the ring 10. They are angularly offset relative to the fins 12 of the first series. In FIG. 1, each fin 14*a* of the second series is disposed halfway between two adjacent fins 12.

The end of each fin 14*a* in the second series penetrates into the ring defined by the tips of the fins 12 of the first series.

The circular support 16 defines an axial passage 18 having a diameter of 0.6 D, for example. Internal fins 14*b* constituting extensions of the fins 14*a* in the second series occupy this passage 18 and point towards the center of the ring 10.

The fins 14*a* of the first series may be of length 0.075 D and may extend longitudinally over 0.2 D, for example. In this configuration, the length and the longitudinal extent of the internal fins 14*b* are identical to the preceding fins.

Figure 1:
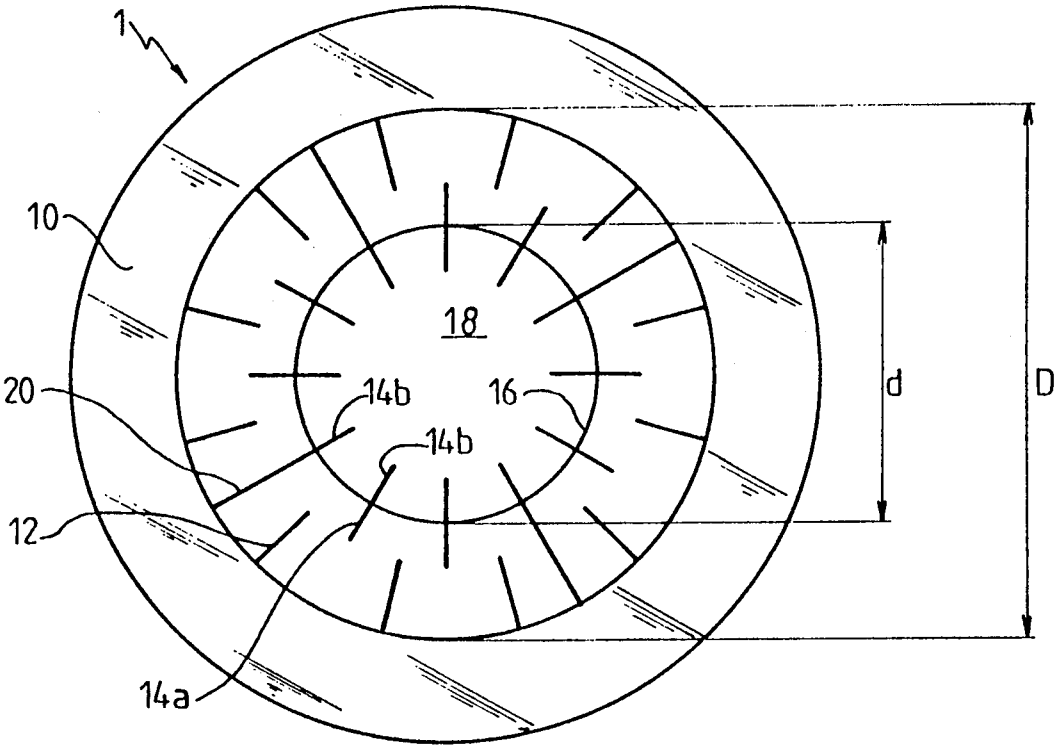
FIG. 1 is a diagrammatic front view of an embodiment of the invention.

In the embodiment shown in FIG. 1, the circular support 10 is fixed to the inside face of the ring by means of four fixings 20. In this example, the fixings 20 are regularly distributed around the circumference of the ring and replace respective fins 14*a*.

The ring 10, the support 16, the fixings 20, and the fins 12, 14*a*, and 14*b* are made of molded plastic or of any other material suitable for withstanding the stresses induced by the flow.

If the fluid flow possesses a main vortex motion, a first series of marginal vortices is formed at the end of each fin 12 rotating in the opposite direction to the incident vortex.

A marginal vortex rotating in the opposite direction to the vortices created by the first series of fins is also formed, in the vicinity of the end of each of the fins 14*a* in the second series.

These vortices are generated in a peripheral region substantially delimited by the circular support 16, i.e. in the zone where the rotary velocity of the fluid due to the main vortex is at a maximum. A maximum effect of making the fluid flow uniform is obtained by transforming the main vortex into a multiplicity of small-sized marginal vortices. Each vortex due to a fin 14*a* of the second series is paired with a vortex due to a fin 12 of the first series, and the resulting overall effect is that the fluid is made more uniform after a distance of about 1.5 D.

The number of fins is chosen to be great enough to obtain the desired effect. In the embodiment shown in FIG. 1, there are twelve fins in the first series and eight fins 14*a* in the second series, with four of them being replaced by the fixings 20.

Because of these two series of fins, a symmetrical transverse profile is obtained for the flow velocity of the fluid, but this profile nevertheless presents a central bulge corresponding to the fluid passing through the axial passage 18. This bulge in the velocity profile disappears of its own accord after a distance of 2 D to 3 D. The internal fins 14*b* placed in the axial passage 18 enable this distance to be reduced by establishing marginal vortices.

In the embodiment shown in FIG. 1, a substantially plane transverse velocity distribution is obtained after a distance of about 1.5 D after passing through the rectifier.

The apparatus of the invention, which extends over a very short longitudinal distance (about 0.2 D), and which possesses a very small headloss coefficient (about 0.1), makes it possible to make the flow of a fluid uniform after it has travelled a short distance from the rectifier (about 1.5 D).

I claim:

1. A flow rectifier for mounting in a circular section duct conveying a fluid in an axial flow direction, wherein the rectifier comprises, in a ring:

(a) a first means for creating a first series of vortices with a flow rotation velocity transverse to said axial flow direction, substantially all of said first series of vortices having a first direction of rotation, said first means comprising a first series of fins extending inward radially from an inner surface of said ring, each fin in said first series of fins having a substantially planar surface which is aligned substantially parallel to said axial flow direction, each of said fins in said first series of fins being regularly distributed around said inner surface of said ring and contained in a peripheral space region thereof; and (b) a second means for creating a second series of vortices with a flow rotation velocity being transverse to said axial flow direction, substantially all of second series of vortices having a direction of rotation opposite to said first direction of rotation and paired with the vortices created by said first means, said second means comprising a substantially circular support generally centered on the center of said ring and a second series of fins extending radially outward from an outer surface of said substantially circular support, each of said fins in said second series of fins having a substantially planar surface which is aligned substantially parallel to said axial flow direction, each of said fins in said second series of fins being regularly distributed around an outer surface of said substantially circular support, each of said fins in said second series of fins pointing towards said inner surface of said ring and each of said fins in said second series of fins having an end which penetrates into said peripheral space region of said ring, said vortices of said first means and said second means being distributed substantially in said peripheral space region of said ring.

2. The rectifier of claim 1, wherein said circular support delimits an axial passage in the center of said ring, and wherein said fins of said second series of fins extend into said axial passage.

3. The rectifier of claim 1, wherein each of said fins of said second series of fins is angularly offset relative to each of said fins of said first series of fins in such a manner that each fin of said second series of fins is disposed substantially halfway between each two adjacent fins of said first series of fins.

4. The rectifier of claim 1 further including internals fins fixed on said circular support and extending into an axial passage delimited thereby.

5. The rectifier of claim 4 wherein said internal fins are comprised of extensions of said fins of the second series of fins.

6. The rectifier of claim 2, including internal fins fixed on said circular support and extending into the axial passage thereof.

7. The rectifier of claim 6, wherein said internal fins are the extensions of said fins of said second series of fins.

8. A flow rectifier mounted in series with a duct containing a fluid having a main axial flow direction, comprising:

(a) a ring including a first series of structures extending radially from an inside surface of said ring for creating a first series of vortices, respectively, with a flow rotation velocity being transverse to said axial flow direction, substantially each of said first structures being contained in a peripheral region of said ring;

(b) a support mounted within said ring and being generally centered with respect to the inside surface thereof; and (c) a second series of structures mounted to said center support and extending radially outward towards the inside surface of the ring such that distal ends of said second structures extend into the peripheral region of said ring in circumferentially spaced relation to said first structures, said second series of structures being operable to respectively create a second series of vortices having a flow rotation velocity which is transverse to said axial flow direction and opposite to the rotational direction of said vortices of said first series of structures, whereby adjacent ones of said first series of structures and said second series of structures are paired so that the respective vortices tend to cancel each other.

* * * * *